US007488018B2

(12) United States Patent
Rommelmann, Jr.

(10) Patent No.: US 7,488,018 B2
(45) Date of Patent: Feb. 10, 2009

(54) METHOD AND APPARATUS FOR REMOTELY AFFIXING AND REMOVING DECORATIVE LIGHTING FROM BUILDING GUTTERS

(76) Inventor: D. William Rommelmann, Jr., 11903 Stoney Ridge La., Houston, TX (US) 77024

( * ) Notice: Subject to any disclaimer, the term of this patent is extended or adjusted under 35 U.S.C. 154(b) by 0 days.

(21) Appl. No.: 11/600,260

(22) Filed: Nov. 15, 2006

(65) Prior Publication Data

US 2007/0114337 A1 May 24, 2007

Related U.S. Application Data

(60) Provisional application No. 60/736,987, filed on Nov. 15, 2005.

(51) Int. Cl.
*A47F 13/06* (2006.01)

(52) U.S. Cl. ..... 294/19.1; 248/48.2

(58) Field of Classification Search ..... 248/48.1, 248/48.2; 294/19.1; 52/11
See application file for complete search history.

(56) References Cited

U.S. PATENT DOCUMENTS 4,241,548 A * 12/1980 Rowe ..... 52/11
5,496,005 A 3/1996 Dieringer
5,553,905 A 9/1996 Bentivegna
5,560,975 A 10/1996 Casper
5,566,058 A 10/1996 Protz, Jr.
5,617,678 A * 4/1997 Morandin et al. ..... 52/11
5,868,334 A 2/1999 Cedillo
5,960,591 A * 10/1999 Schluter ..... 52/11
6,109,765 A 8/2000 Blanton
6,328,459 B1 12/2001 Adams
6,352,291 B1 3/2002 Tortajada
6,572,062 B1 6/2003 Limber et al.
6,685,151 B2 2/2004 Vasquez et al.
6,827,379 B2 12/2004 Hill et al.

* cited by examiner

*Primary Examiner*—Ramon O Ramirez
(74) *Attorney, Agent, or Firm*—Douglas W. Rommelmann; Andrews Kurth LLP

(57) ABSTRACT

An assembly and method for remotely affixing and removing decorative lighting from a building gutter. The assembly includes a hanger having a body portion with a first body segment joined to a catch portion and a second body segment joined to a hook portion. The catch portion is adjacent a gutter back wall and the hook portion is adjacent a gutter upper lip upon the hanger being affixed to the gutter. The hanger includes a securing member adapted to secure the decorative lighting to the hanger. The assembly further includes a positioning implement having an engagement member and a pole attached to the positioning implement. The engagement member is releasably received by a connector of the hanger. The method for remotely affixing and removing decorative lighting from the gutter comprises releasably engaging the engagement member of a positioning implement to the connector of the hanger apparatus. The decorative lighting and the hanger apparatus are simultaneously positioned via the positioning implement and attached pole. The engagement member is then released from the connector.

20 Claims, 7 Drawing Sheets

FIG.3
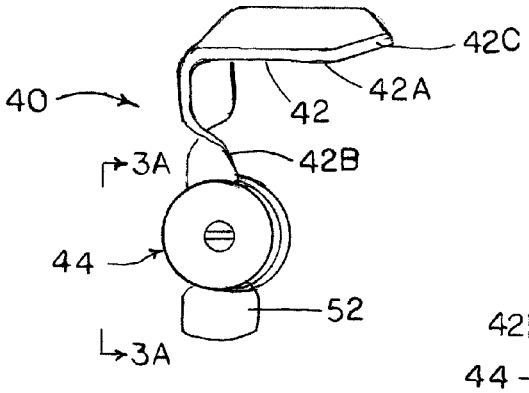
FIG.3B
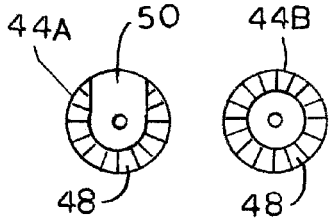
FIG.3C
FIG.3A
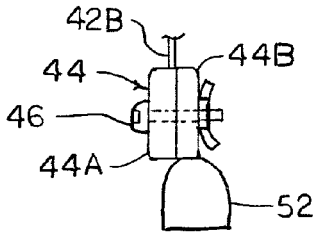
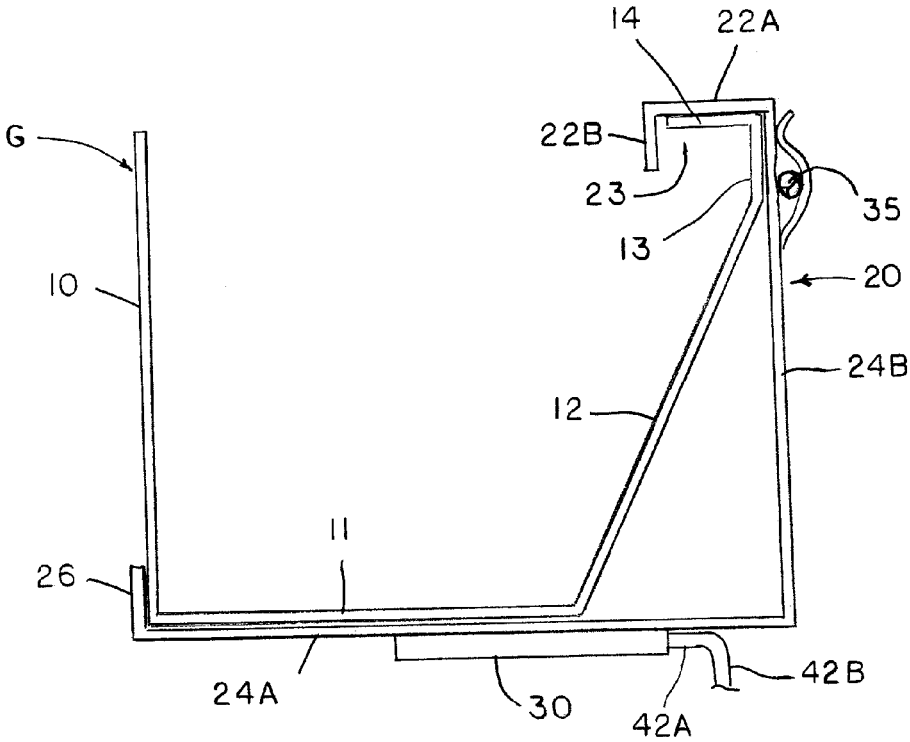
FIG. 6

FIG. 7
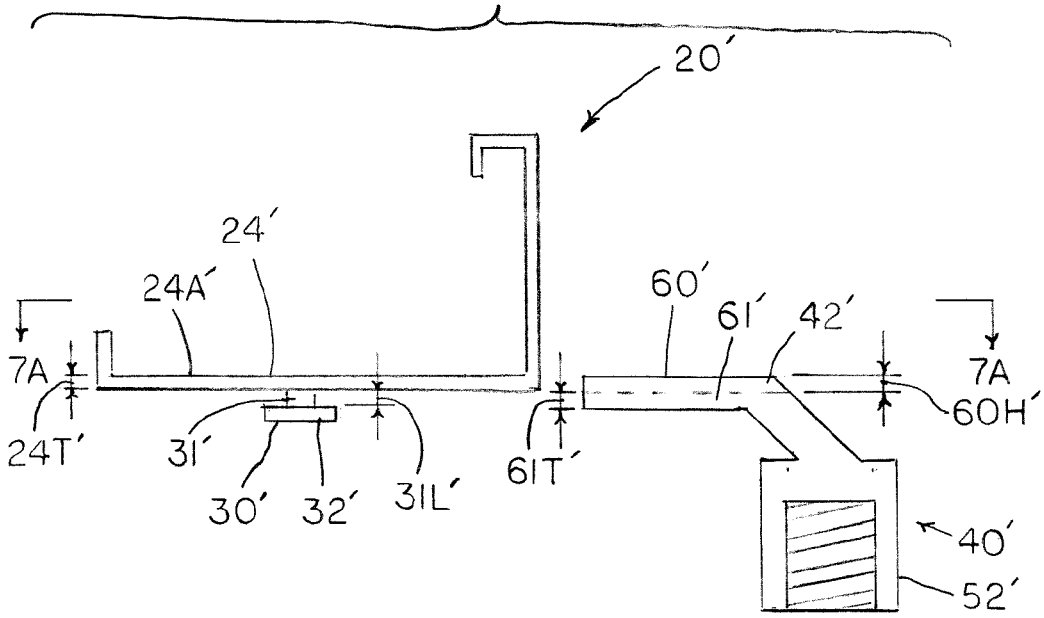
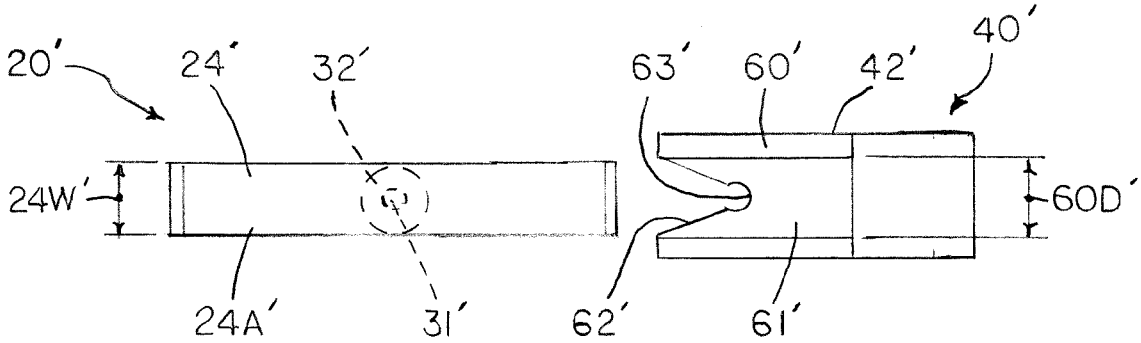
FIG. 7A

METHOD AND APPARATUS FOR REMOTELY AFFIXING AND REMOVING DECORATIVE LIGHTING FROM BUILDING GUTTERS

CROSS-REFERENCE TO RELATED APPLICATIONS

The present application claims priority from Provisional Application Ser. No. 60/736,987, filed on Nov. 15, 2005. Applicant incorporates by reference herein Provisional Application Ser. No. 60/736,987.

BACKGROUND OF THE INVENTION

1. Field of the Invention

The present invention relates to a method and apparatus for remotely affixing and removing decorative lighting from gutters of a building, and more particularly, to a method and apparatus for affixing and removing strands of electric holiday lights from house gutters.

2. Description of the Related Art

Decorative lighting is often placed on gutters of structures, such as buildings and houses. This is particularly true during various holiday seasons, most notably the Christmas season, when many people enjoy decorating their houses and yards. The decorative lighting used is typically "strings" or "strands" of electric bulbs. The strands come in various lengths with various numbers and sizes of bulbs distributed along the strand length. There are a variety of types of strands marketed for outdoor use, some of which are particularly suited for affixing to a structure such as a house. One such type is commonly referred to as "icicle" lights, which has short segments of lights depending or hanging downwardly along the length of the light strand. Oftentimes, light strands are affixed or "hung" from rain gutters attached to the house. Since the light strands do not include a means for affixing the strands to the house or gutters, various devices are available for attaching light strands to the house and/or gutters.

Gutters are typically at a greater height than a person can reach while standing on the ground below. As a result, the homeowner or person typically uses a ladder to put up and take down strands of lights from the gutter. The required use of a ladder presents several risks and difficulties. For some people, physical limitations do not allow them to get up on a ladder. Additionally, there is always a risk of falling off the ladder, a risk that is somewhat greater when the ground support for the ladder may be constricted, obstructed, unlevel or soft. Quite commonly, there are physical obstructions to placing the ladder in the needed position adjacent to the building because of trees, bushes or other plants or shrubbery. Furthermore, many existing devices for affixing lights to a gutter require both hands to install, leaving no means for safely balancing or grasping a ladder. The difficulty of this process is further compounded due to the fact that in many regions holiday decorating takes place in wet, cold or icy conditions.

U.S. Pat. No. 5,553,905, issued to Bentivegna, for "Ornament Handling Apparatus," discloses an apparatus for handling ornaments and other objects, including an elongated handle and a hook-shaped applicator. The applicator is attached to one end of the elongated handle and a hook receiving hole extends partially into the applicator to hold the ornament hook therein. The apparatus includes a retriever for removing ornaments and an applicator affixed to a connector for attachment to an elongated handle.

U.S. Pat. No. 5,566,058, issued to Protz, Jr., for "Light Clip for Shingles or Gutters," discloses a light clip for holding a light bulb with an attachment portion for removably mounting the light clip to a support surface such as a shingle or gutter without putting holes in the gutters or shingles. The attachment portion has a mechanism with a plurality of discrete stop positions, and cooperates with a bulb holder having connecting prongs. The mechanism with discrete stops cooperates with the prongs to mount the bulb holder to the attachment portion and to provide a plurality of discrete angular positions of a bulb carried by the bulb holder with respect to the attachment portion. The gutter attachment portion is capable of mounting to a variety of gutter shapes.

U.S. Pat. No. 5,868,334, issued to Cedillo, for "Light Hanging Extension Device and Method for Using Same," discloses a device for storing and hanging a continuous string of lights on a tree. The device includes a spool assembly having first and second annular plates spaced apart and connected to a cylinder member. One of the annular plates is adapted to releasably secure an end portion of the string of lights in a fixed position. An axle structure is removably secured within a bore of the cylinder member. The axle structure has a holding mechanism releasably securing the axle structure to the cylinder member. A handle is coaxially mounted to the axle structure. An elongated pole is provided having a first end portion removably coaxially secured to the handle. The elongated pole is sized for extending and elevating the spool assembly upwardly in close adjacency with branches of a tree when a user grasps a second end portion of the elongated pole. The spool assembly can be moved around a perimeter of the tree to enable the string of lights of be progressively strung about the tree.

U.S. Pat. No. 5,560,975, issued to Casper, for "Decorating System," discloses a decorating system that enables decorative articles to be hung from high places with safety. The decorating system comprises a dual hook and an adapter. The dual hook has a ring, a first hook, and a second hook. The decorative article is held by the second hook. The adapter is attached to the end of a pole and has a finger that is insertable into the dual hook ring, much like a carnival game. A user manipulates the pole to locate the dual hook over a selected support member and then the dual hook is lowered slightly to rest the first hook on the support member. The adapter finger is then removed from the dual hook ring. To take down the decorative article, the adapter finger is reinserted into the dual hook ring, and the pole is manipulated to lift the dual hook off the support member and return the dual hook and decorative article to the ground.

U.S. Pat. No. 6,352,291, issued to Tortajada, for "Implement and System for Remotely Affixing and removing Decorations and Other Objects," discloses an article for affixing and removing a strand of lights or other decorations to and from a particular place such as a roof, gutter or tree, and a method for performing those tasks. An elongated positioning implement has a substantially U-shaped distal end for receiving and holding a wire or light strand. A dividing post is located between the fingers of the U-shape. A downwardly oriented finger can also be attached to a portion of the U-shaped distal end. A temporary hanger may be put in place on a gutter on a building using the positioning implement. Once the temporary hanger is in place, the positioning implement is used to affix the strand of lights by placing it on the temporary hanger. The positioning implement can also be used to remove both the strand of lights and the temporary hook simultaneously.

It would be desirable to provide an apparatus and method for allowing a person to affix and remove decorations such as holiday lights at a height greater than the reach of the person and without using a ladder. It would be further desirable to have an apparatus and method that would permit a user to affix and remove holiday lights on a gutter of a house while standing on the ground. It would be further advantageous to provide an easy to use means for affixing a removable hanger to a gutter without the need for a ladder. Additionally, it would be advantageous to use a positioning implement in conjunction with a hanger for temporarily affixing the hanger on a gutter from which to hang decorations, such as a strand of lights. Another advantage would be for the temporary hanger to cause no permanent damage or other lasting after effects to the gutter. Another advantage of such a system would be for all items put in place with the positioning implement to be easily removable by the user without the need for a ladder. It would also be advantageous to provide means for a removable hanger to become attached to the item being hung, such as a strand of holiday lights, so that, when the hanging item is removed, the removable hanger is prevented from being lost, or falling into the gutter, for example.

SUMMARY OF THE INVENTION

The primary advantages enjoyed by the user of the present invention are the increases in safety, convenience and speed with which items, such as holiday decorations, can be put up and taken down as compared to previous known methods.

The present invention provides an apparatus and method for allowing a person to affix and remove decorations such as holiday lights at a height greater than the reach of the person and without using a ladder. In the preferred embodiments of the present invention, the apparatus and method permits the user to affix and remove holiday lights on a gutter of a house while standing on the ground. It also provides an easy to use means for affixing a removable hanger to a gutter without the need for a ladder.

Preferably, the apparatus includes a hanger, from which to hang decorations such as a strand of lights, used in conjunction with a positioning implement for temporarily affixing the hanger on a gutter. In the preferred embodiments, the temporary hanger causes no permanent damage or other lasting after effects to the gutter. Preferably, the hanger and the light strand are both installed and removed via the positioning implement without the need for a ladder. Furthermore, the hanger preferably remains attached to the light strand so that upon removal it is prevented from becoming lost or inadvertently falling into the gutter.

BRIEF DESCRIPTION OF THE DRAWINGS

In the following drawings, which form a part of the specification and which are to be construed in conjunction therewith, and in which like reference numerals have been employed throughout whenever possible to indicate like parts in the various views:

FIG. 3 is a perspective view of a preferred positioning implement for use with the hanger of FIG. 2;

FIG. 3A is a view taken along lines 3A-3A of FIG. 3;

FIGS. 3B and 3C are elevation views of the interior of the hub members;

FIG. 6 is a side view of the hanger installed on the gutter;

FIG. 7 is a side view of an alternate embodiment of the hanger and positioning implement;

FIG. 7A is a view taken along lines 7A-7A of FIG. 7;

DETAILED DESCRIPTION OF THE PREFERRED EMBODIMENT

Figure 4:
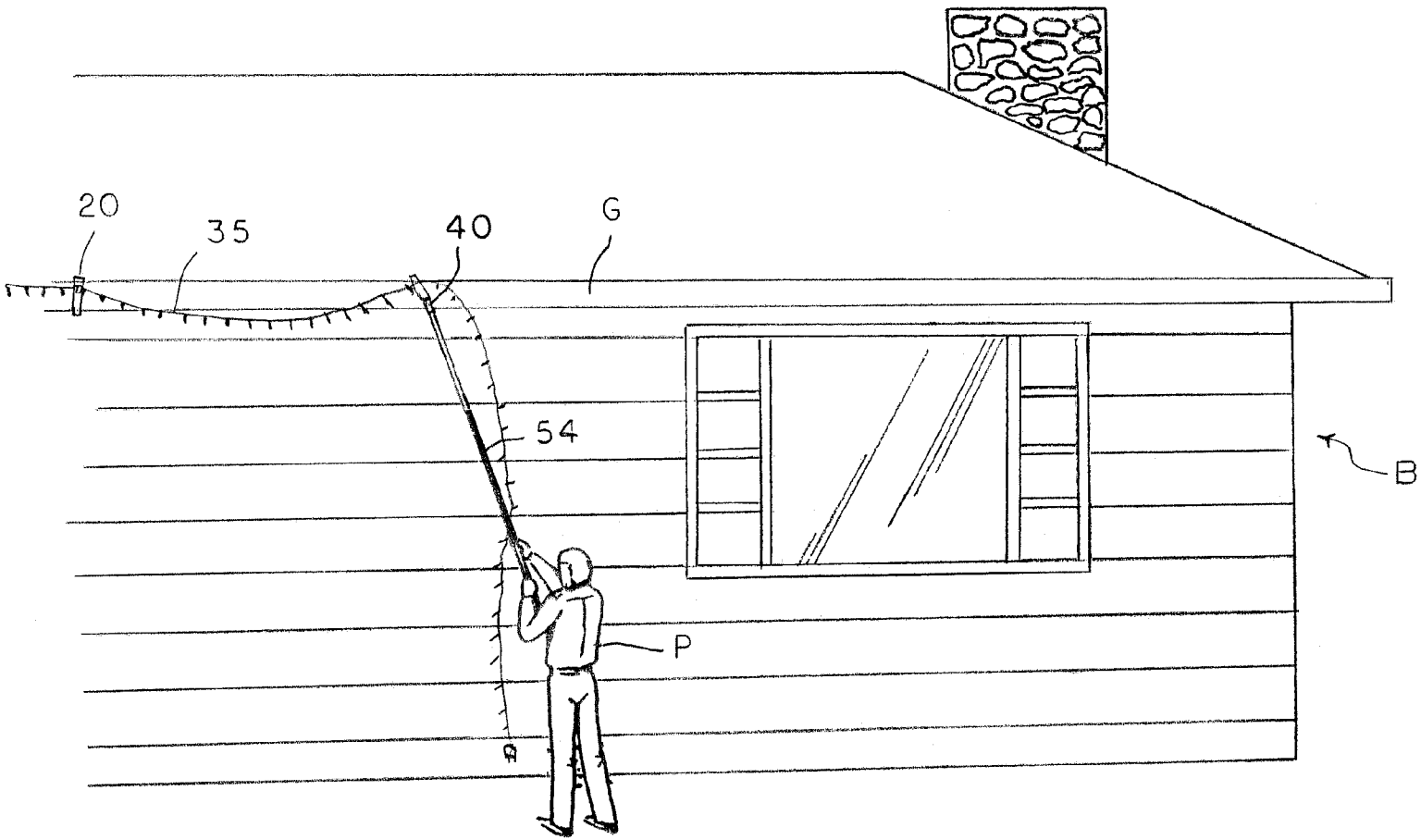
FIG. 4 is an elevation view of a portion of a house with a gutter and a person installing a hanger with a light strand according to a method of the present invention.

The present invention will now be described in detail with reference to the drawings. Referring to FIG. 4, the preferred embodiment of the present invention is an apparatus and method for affixing and removing decorations, such as a string of lights 35, from a gutter G on a building B using a positioning implement 40 attached to a pole 54. The preferred embodiment of the present invention includes a removable hanger 20 and a method for affixing and removing the removable hanger 20, including the string of lights 35, from the gutter G.

Figure 1:
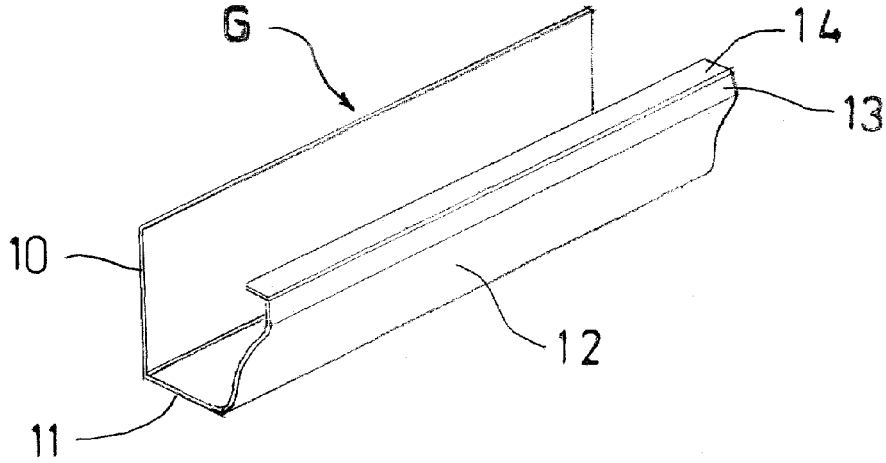
FIG. 1 is a perspective view of a typical rain gutter commonly used on a house or building.

A typical rain gutter G is shown in perspective view in FIG. 1. The rain gutter G, commonly attached to a house or building, has a channel-like shape for receiving rain water running off a roof and transporting the rain water to a downspout. The gutter G shown in FIG. 1 includes a back wall 10, a bottom wall 11, and a front wall 12. Typically, the front wall 12 has upper portion 13 forming a lip 14 angled towards the back wall 10 to provide added rigidity to the gutter G. The depiction in FIG. 1 is merely illustrative of a typical shape of a gutter G and it is to be understood that the present invention is not limited to the gutter shapes shown in the drawings.

Figure 2A:
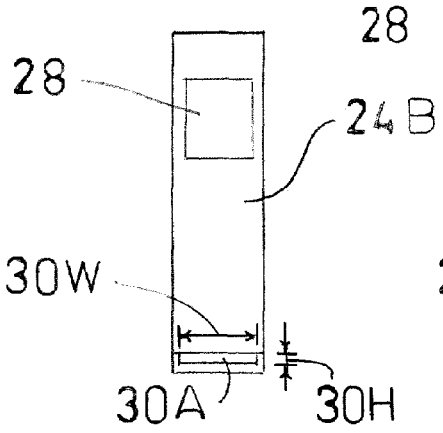
FIG. 2A is an elevation view of the hanger of FIG. 2.
Figure 2:
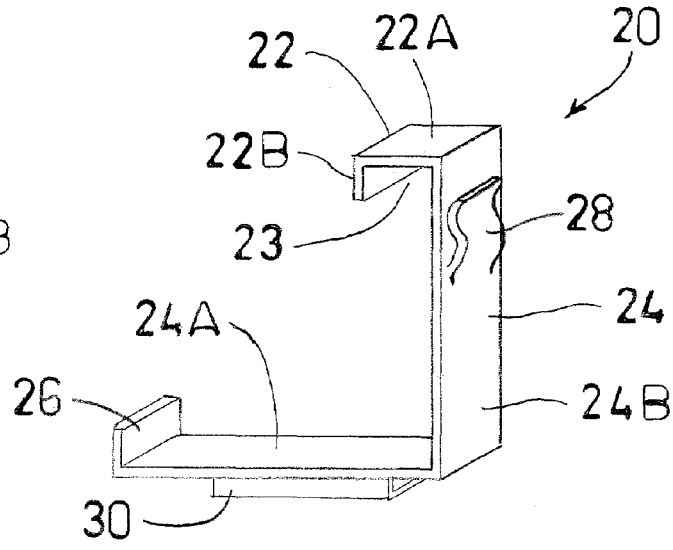
FIG. 2 is a perspective view of one preferred embodiment of the hanger.

Referring to FIG. 2, the hanger 20, according to one preferred embodiment of the present invention, is shown in perspective view. The hanger 20 preferably includes a hook portion 22, a body portion 24 and a catch member 26. The hook portion 22 forms an opening 23. The hanger 20 also includes securing means 28 for attaching a portion of a light string thereto. The securing means 28 could be a clip, hook, clamp or any other type of device known to those of skill in the art. The hanger 20 also preferably includes a connector 30 for releasably connecting to a positioning implement 40 (FIG. 3). The hanger 20 can be constructed of metal, but plastic is preferred, as it is advantageous to have electrically non-conductive material, since light strands pose potential electrical hazards. The hangers are also easier to manufacture out of plastic.

Still referring to FIG. 2, the hook portion 22 includes a first hook segment 22A and a second hook segment 22B that is substantially transverse to the first hook segment 22A. The body portion 24 includes a first body segment 24A and a second body segment 24B that is preferably substantially transverse to the first body segment 24A. The catch member 26 is attached to or integrally formed at an end of the first body segment 24A.

In the preferred embodiment, the first body segment 24A is substantially parallel to the first hook segment 22A and the second body segment 24B is substantially parallel to the second hook segment 22B. The catch member 26 is substantially parallel to the second body segment 24B.

Still referring to FIG. 2, the securing means 28 is preferably formed or connected to the second body segment 24B. Preferably, the location of the securing means 28 is near an upper end of the second body segment 24B. The connector 30 is preferably formed or attached to a lower surface of the first body segment 24A. The connector 30 includes an opening 30A as shown in FIG. 2A for reasons which will be explained below.

Referring now to FIG. 3, there is shown a perspective view of the positioning implement 40 for use with the hanger 20 shown in FIG. 2. The implement 40 can be constructed of metal, but plastic is again preferred. The implement 40 preferably includes an engagement member 42 adapted to be received within the connector opening 30A (FIG. 2A). Preferably, the engagement member 42 is snugly, yet slidably received within the connector 30 to prevent inadvertent disengagement. Additionally, the engagement member 42 can preferably be inserted into the connector opening 30A from either end of the connector 30. As shown in FIG. 3, the engagement member 42 preferably has a first engagement segment 42A and a second engagement segment 42B. The first engagement segment 42A preferably includes a pointed end 42C to facilitate insertion into the connector opening 30A. The second engagement segment 42B is generally transverse to the first engagement segment 42A and may include a ninety degree (90°) twist as shown in FIG. 3.

Preferably, the connector opening 30A has a width 30W (FIG. 2A) slightly greater than the width 42W (FIG. 3A) of the first engagement segment 42A and a height 30H (FIG. 2A) slightly greater than the thickness 42T of the first engagement segment 42A.

Preferably, a lower end of the second engagement segment 42B is attached to a hub assembly 44 as shown in FIGS. 3 and 3A. Preferably, the hub assembly 44 includes first and second hub members 44A and 44B, respectively. As shown in FIG. 3A, the hub members 44A and 44B are joined together with a fastener 46, preferably a threaded fastener and nut. Each of the hub members 44A, 44B includes an outer ring of serrations or teeth 48 adapted to interengage with the teeth 48 of the other hub member. As shown in FIG. 3B, the first hub member 44A preferably includes a recess 50 adapted to receive the lower end of the second engagement member 42B. The second hub member 44B is preferably attached to a socket 52 adapted to connect with the elongated pole or member 54 (FIG. 4). Preferably, the socket 52 and the end of the pole 54 are threaded together (not shown) to firmly secure the positioning implement 40 to the pole 54. It is to be understood that the elongated member 54 could have a fixed length or an adjustable length, as for example a telescoping pole assembly. The preferred configuration of the hub assembly 44 permits the user to adjust the angle of the first engagement segment 42A relative to the elongated pole 54 via the mating teeth 48 and fastener 46 to facilitate installation and removal of the hanger 20 as will be further described below.

Figure 5:
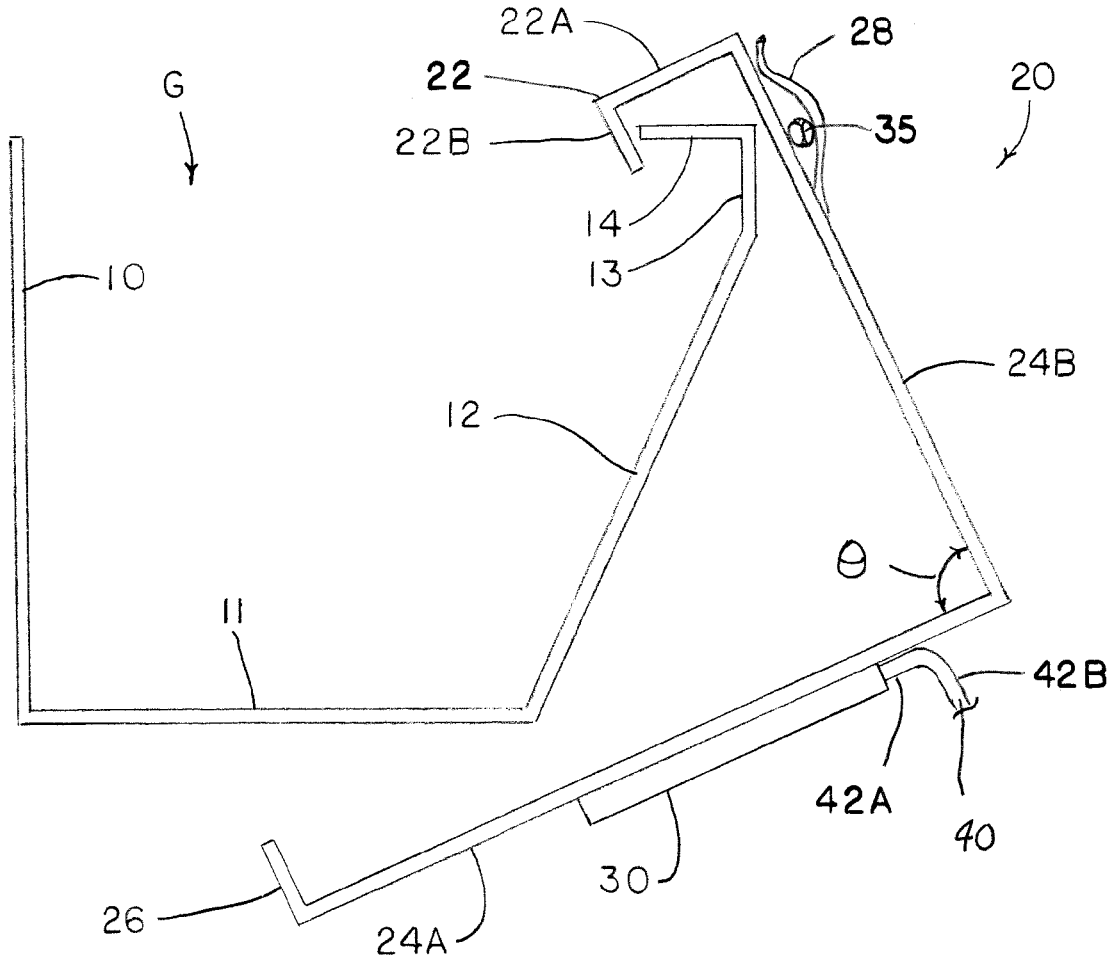
FIG. 5 is a side view of the hanger being installed on the gutter with the positioning implement.

Referring to FIG. 4, a person P is shown using the positioning implement 40 with a pole 54 to affix a strand of lights 35 to a gutter G of a house B. Preferably, the person P attaches a hanger 20 to the light strand 35 via the securing means 28 about every 8 to 12 feet of length of the strand 35. This is preferably done prior to installing the hanger 20 on the gutter G. The person P then slidably attaches the positioning implement 40 to the hanger connector 30 and raises the hanger hook portion 22 to the upper portion 13 of the gutter G. Referring to FIG. 5, the hanger hook portion 22 is positioned over the gutter lip 14 and then lowered to capture the gutter lip 14 in the hook opening 23. The person P next manipulates the positioning implement 40 via the pole 54 to bring the catch member 26 into engagement with the back wall 10 of the gutter G as shown in FIG. 6. Preferably, before the catch member 26 is finally positioned, the person P directs the hanger 20 to the proper location along the length of the gutter G using the implement 40. Once the catch member 26 is in engagement with the back wall 10, the engagement member 42 is slidably removed from the opening 30A of the connector 30. The person P is now ready to install the next hanger 20 on the gutter G.

It is to be understood that with reference to FIG. 4, the person P may slide the implement-attached hanger 20 along the length of the gutter G until the slack is taken out of the light strand 35 between adjacent hangers 20 prior to securing the hanger catch member 26 to the gutter G, if desired.

It is to be understood that the installation procedure may substantially be reversed to remove the hanger 20 and the light strand 35 from the gutter G. The primary difference is that the pointed end 42C of the engagement member 42 must be stabbed into the connector opening 30A while the hanger is attached to the gutter G. The pointed end 42C facilitates the distant stabbing step. It is also to be understood that, with reference to FIG. 5, the engagement member 42 of the positioning implement 40 can preferably be inserted into the opening 30A from either end of the connector 30. The hub assembly 44 as shown in FIGS. 3 and 3A allows the user to adjust the angle of the first engagement segment 42A relative to the elongated pole 54 to facilitate the installation and removal of the hanger 20. Angular adjustment may be needed or desired due to various factors, for example, the height of the gutter G, the distance from the house the person stands when installing or removing the hanger, or interfering obstacles such as trees, shrubs and bushes.

Figure 8:
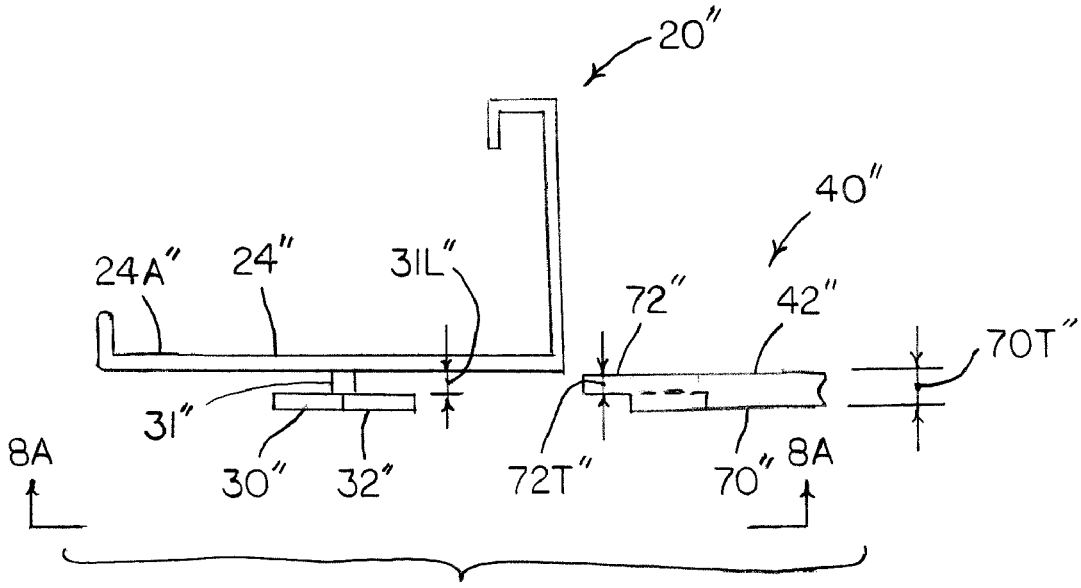
FIG. 8 is a side view of an alternate embodiment of the hanger and positioning implement.

FIGS. 7 and 8 illustrate two other embodiments of the hanger and positioning implement according to the present invention. It is to be understood that in each of the embodiments of FIGS. 7 and 8, the connector and the positioning tool have been modified and the securing means 28 is not shown.

Referring to FIGS. 7 and 7A, the connector 30' of the hanger 20' includes a stub 31' extending from the body portion 24'. A plate 32' is secured to the end of the stub 31'. The positioning implement 40' is not shown with the hub assembly 44 of implement 40 although it is to be understood that the hub assembly could also be used with implement 40'. The implement 40' preferably includes a socket 52' for mounting to a pole 54 (not shown). Preferably, the implement 40' includes an engagement member 42' comprising a pair of elevated side walls 60' extending above a substantially planer face member 61'. Preferably, the distance 60D' between the pair of side walls 60' is slightly greater than the width 24W' (FIG. 7A) of the first body segment 24A' and the height 60H' (FIG. 7) of the walls 60' above the face member 61' is approximately the thickness 24T' of the first body segment 24A'. Additionally, the length 31L' of the stub 31' is slightly greater than the thickness 61T' of the face member 61'.

Referring to FIG. 7A, the face member 61' of the engagement member 42' preferably includes a tapered notch 62' terminating in a receiver 63' for receiving and frictionally engaging the stub 31'. The tapered notch 62' primarily facilitates stabbing of the engagement member 42' onto the installed hanger 20' during removal from the gutter G. Preferably, the first body segment 24A' is slid along the face member 61' and between the pair of side walls 60' until the stub 31' is snugly, but releasably, received in the receiver 63'. It is to be understood that the side walls 60' maintain the axial orientation of the hanger first body segment 24A' relative to the engagement member 42' and the frictional engagement of the stub 31' with the receiver 63' maintains the engagement of the hanger 20' with the positioning implement 40'. Additionally, the plate 32' is larger than the receiver 63' and cooperates with the first body segment 24A' to maintain proper attachment and alignment of the hanger 20' relative to the positioning implement 40'.

Figure 8A:
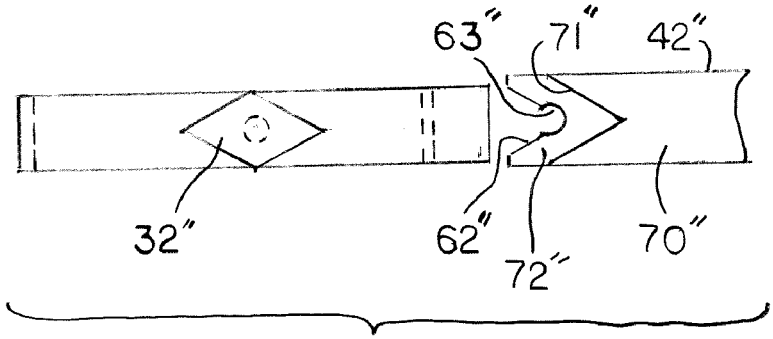
FIG. 8A is a view taken along lines 8A-8A of FIG. 8.

Now referring to FIGS. 8 and 8A, the connector 30" of the hanger 20" includes a stub 31" extending from the body portion 24". A plate 32" is secured to the end of the stub 31". The plate 32" is shown as preferably having a diamond shape. It is to be understood that other shapes are contemplated and within the scope of the present invention; however the diamond shape has been shown for purposes of illustrating this embodiment of the invention. The positioning implement 40" is not shown with the hub assembly 44 of implement 40 although it is to be understood that the hub assembly could also be used with implement 40". It is to be understood that although not shown, the implement 40" preferably includes a socket or other means for attaching or mounting to a pole as described above. Preferably, the implement 40" includes an engagement member 42" having first and second segments 70" and 72", respectively. The second segment 72" has a thickness 72T" which is less than the thickness 70T" of the first segment 70" as shown in FIG. 8. Referring to FIG. 8A, the transition of the second segment 72" to the first segment 70" is defined by a V-shaped end face 71" which substantially corresponds with opposing halves of the diamond-shaped plate 32" as seen in FIG. 8A. The second segment 72" of the engagement member 42" preferably includes a tapered notch 62" terminating in a receiver 63" for receiving and frictionally engaging the stub 31". The tapered notch 62" primarily facilitates stabbing of the engagement member 42" onto the installed hanger 20" during removal from the gutter G.

Preferably, the length 31L" of the stub 31" is slightly greater than the thickness 72T" of the second segment 72" and the thickness 70T" of the first segment 70" is greater than the length 31L" of the stub 31".

Preferably, the first segment 72" of the engagement member 42" is slid along the hanger first body segment 24A" until the tapered notch 62" accepts the stub 31" and the stub 31" is snugly, but releasably, received in the receiver 63". Preferably during the acceptance of the stub 31" into the tapered notch 62" and the receiver 63", approximately one half of the diamond-shaped plate 32" cooperatively engages the V-shaped end face 71".

It is to be understood that the cooperative engagement of the end face 71" and the plate 32" maintains the axial orientation of the hanger first body segment 24A" relative to the engagement member 42" and the frictional engagement of the stub 31" with the receiver 63" maintains the engagement of the hanger 20" with the positioning implement 40". Additionally, the second segment 72" is retained between the plate 32" and the first body segment 24A" to maintain proper attachment of the hanger 20" to the positioning implement 40".

Figure 9:
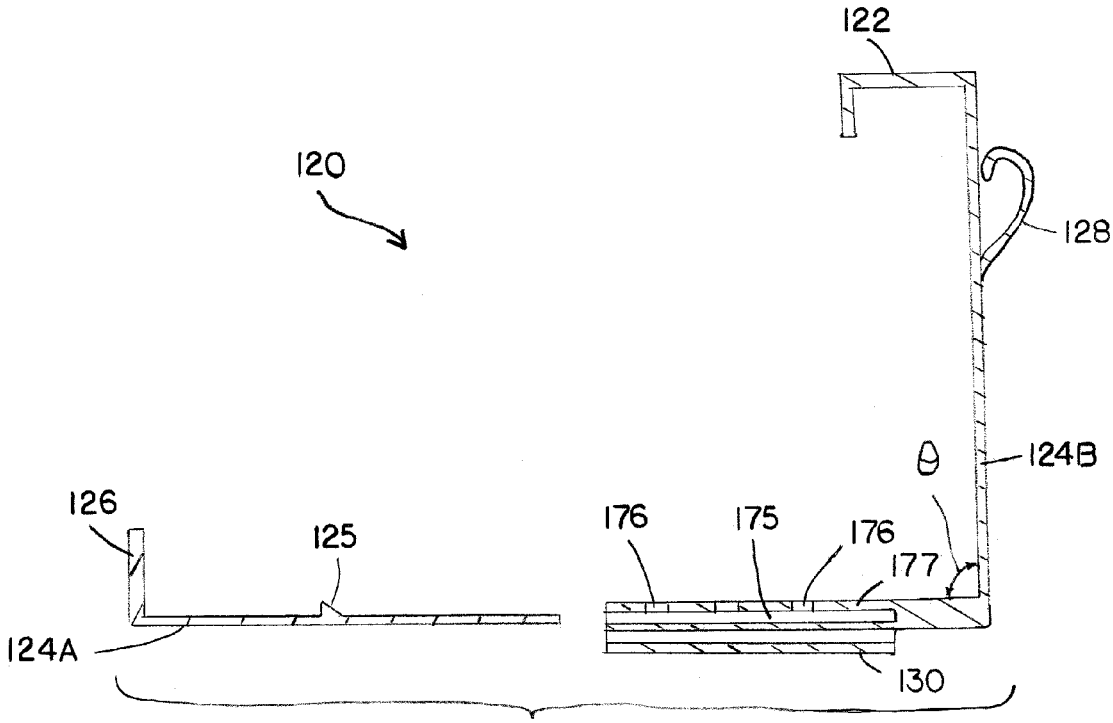
FIG. 9 is a sectional side view of another preferred embodiment of the hanger according to the present invention.
Figure 10:
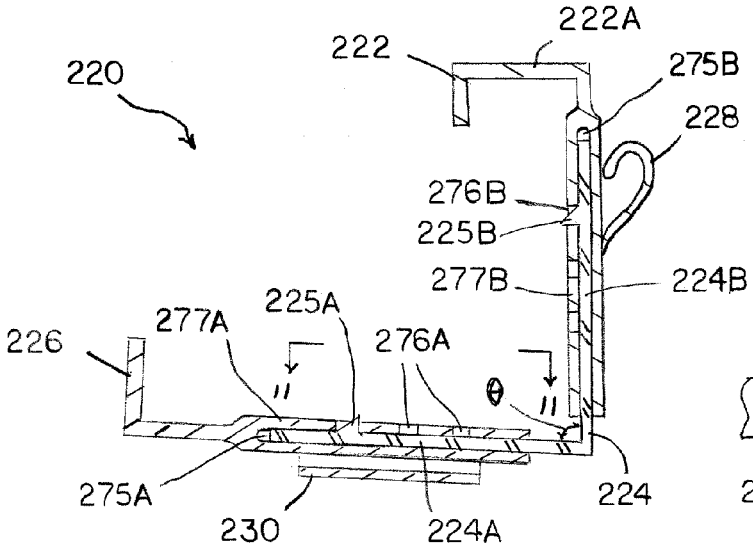
FIG. 10 is a sectional side view of another preferred embodiment of the hanger according to the present invention.

FIGS. 9 and 10 illustrate two additional embodiments of the hanger according to the present invention. Both of the embodiments of FIGS. 9 and 10 are adjustable to accommodate different sizes and shapes of gutters G. It is to be understood that gutters are available in different sizes, typically 4", 5" or 6", and the cross-sectional shape varies among the different manufacturers. The present invention is best suited for gutters G having a generally planer back wall 10 and a generally planer bottom wall 11 at substantially a 90° angle with respect to each other as shown in FIGS. 1 and 6. Such angular transition provides a desirable configuration for the catch member 26 to secure the hanger to the gutter G.

Referring to FIG. 9, the hanger 120 is of two piece construction. The assembled hanger 120 is very similar to the hanger 20 of FIG. 2 with a few exceptions as discussed below. The hanger 120 includes a first piece including a catch member 126 and a first body segment 124A. The second piece includes a hook portion 122, a securing means 128, a connector 130, a second body segment 124B, and a receptacle 175. It is to be understood that the connector 130 is shown as being similar to connector 30 of FIG. 2, although other connector designs could also be used. Preferably, the first body segment 124A includes a raised projection 125 adapted to be received within any one of a plurality of windows 176 extending through an upper wall 177 of the receptacle 175. The plurality of windows 176 provide adjustment in the length between the catch member 126 and the second body segment 124B depending on the window 176 receiving the projection 125.

Figure 11:
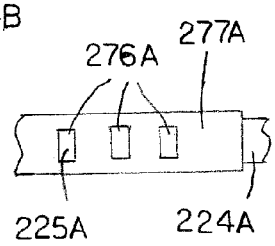
FIG. 11 is a view taken along lines 11-11 of FIG. 10.

Referring to FIGS. 10 and 11, the hanger 220 is of multipiece construction. This embodiment provides length adjustment in both the vertical and horizontal directions, if desired. It is to be understood that the adjustment could alternatively be provided solely in the vertical direction or solely in the horizontal direction. Preferably, the hanger 220 includes a first piece including a catch member 226, a connector 230, and a first receptacle 275A. It is to be understood that the connector 230 is shown as being similar to connector 30 of FIG. 2, although other connector designs could also be used. Preferably, the second piece includes a hook portion 222, a securing means 228, and a second receptacle 275B. The first and second receptacles 275A and 275B include a plurality of windows 276A and 276B, respectively, extending through a receptacle wall 277A and 277B, respectively. A body member 224 includes first and second body segments 224A and 224B, respectively, having first and second raised projections 225A and 225B, respectively. The raised projection 225A is adapted to be received within any one of the plurality of windows 276A to provide adjustment in the length between the catch member 226 and the second body segment 224B. Additionally, the raised projection 225B is adapted to be received within any one of the plurality of windows 276B to provide adjustment in the length between the hook segment 222A and the first body segment 224A.

Referring to FIG. 10, preferably the angle θ between the first and second body segments 224A and 224B is 90° or smaller. Angle θ is shown as being less than 90° in FIG. 10. It is to be understood that the angle θ in all of the embodiments is preferably 90° or smaller. It is also to be understood that the hanger according to the present invention does not need to have an abrupt transition between the first and second body segments as shown in the figures, but rather may have a smooth, arcuate or curved transition between the segments.

Preferably, the hanger has some flexibility along its members which allows minor flexing hanger body during the installation and removal process, but flexes back to securely maintain the position of the hanger once in place on the gutter G. Preferably, the installed hanger is slightly flexed to provide additional holding and frictional force against the gutter G.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention.

I claim:

1. An assembly for remotely affixing and removing decorative lighting from a building gutter, the building gutter having a back wall, a bottom wall, and a front wall having an upper lip, the assembly comprising:

a hanger apparatus comprising:

a body portion having a first body segment joined to a catch portion and a second body segment joined to a hook portion, wherein said catch portion is adjacent the gutter back wall and said hook portion is adjacent the upper lip upon said hanger apparatus being affixed to the gutter;

a securing member joined to said body portion, said securing member adapted to secure the decorative lighting to said hanger apparatus; and a connector attached to said hanger body portion;

a positioning implement comprising an engagement member, said engagement member being releasably received by said connector; and a pole attached to said positioning implement.

2. The assembly of claim 1, wherein said first body segment is substantially transverse to said second body segment.

3. The assembly of claim 1, wherein said first body segment is substantially planer and said second body segment is substantially planer and said first body segment forms an angle with said second body segment of approximately 90°.

4. The assembly of claim 1, wherein said first body segment forms an angle with said second body segment of 90° or smaller.

5. The assembly of claim 1, wherein said catch portion is substantially transverse to said first body segment.

6. The assembly of claim 1, wherein said body portion substantially extends around the front and bottom walls of the gutter upon affixing to the gutter.

7. The assembly of claim 1, wherein said positioning implement further comprises a hub assembly permitting angular adjustment of said engagement member relative to said pole.

8. An assembly for remotely affixing and removing decorative lighting from a building gutter, the building gutter having a back wall, a bottom wall, and a front wall having an upper lip, the assembly comprising:

a hanger apparatus comprising:

a first body segment, said first body segment adjacently below the gutter bottom wall upon said hanger apparatus being affixed to the gutter;

a second body segment coupled to said first body segment, said second body segment adjacent the gutter front wall upon said hanger apparatus being affixed to the gutter;

a catch portion coupled to said first body segment, said catch portion adjacent the gutter back wall upon said hanger apparatus being affixed to the gutter; and a hook portion coupled to said second body segment, wherein said hook portion is adjacent the upper lip upon said hanger apparatus being affixed to the gutter.

9. The assembly of claim 8, wherein said hanger apparatus further comprises a securing member adapted to secure the decorative lighting to said hanger apparatus.

10. The assembly of claim 9, wherein said hanger apparatus further comprises a first adjustment arrangement providing adjustment of a length between said catch portion and said second body segment.

11. The assembly of claim 10, wherein said hanger apparatus further comprises a second adjustment arrangement providing adjustment of a length between said hook portion and said first body segment.

12. The assembly of claim 8, further comprising:

a positioning implement comprising an engagement member;

a pole attached to said positioning implement; and said hanger apparatus having a connector, wherein said engagement member is releasably received by said connector.

13. The assembly of claim 8, wherein said hanger apparatus further comprises an adjustment arrangement providing adjustment of a length between said hook portion and said first body segment.

14. The assembly of claim 8, further comprising:

a positioning implement; and said hanger apparatus including a connector arranged and designed to cooperate with said positioning implement.

15. The assembly of claim 14, wherein said positioning implement includes a hub assembly for angular adjustment.

16. The assembly of claim 14, wherein said connector is coupled to said first body segment.

17. The assembly of 8, wherein said first body segment forms an angle with said second body segment of 90° or smaller.

18. The assembly of claim 8, wherein said hanger apparatus substantially extends around the front and bottom walls of the gutter upon affixing to the gutter.

19. An assembly for remotely affixing and removing decorative lighting from a building gutter, the building gutter having a back wall, a bottom wall, and a front wall having an upper lip, the assembly comprising:

a hanger apparatus comprising:

a first body segment, said first body segment adjacent the gutter bottom wall upon said hanger apparatus being affixed to the gutter;

a second body segment, said second body segment adjacent the gutter front wall upon said hanger apparatus being affixed to the gutter;

a catch portion, said catch portion adjacent the gutter back wall upon said hanger apparatus being affixed to the gutter;

a first adjustment arrangement providing adjustment of a length between said catch portion and said second body segment; and a hook portion, wherein and said hook portion is adjacent the upper lip upon said hanger apparatus being affixed to the gutter.

20. The assembly of claim 19, wherein said hanger apparatus further comprises a second adjustment arrangement providing adjustment of a length between said hook portion and said first body segment.

* * * * *